US005344527A

United States Patent [19]

Mickas

[11] Patent Number: 5,344,527

[45] Date of Patent: Sep. 6, 1994

[54] APPARATUS FOR DISPOSAL OF FILTER MEDIA

[76] Inventor: Anthony Mickas, 2361 North Shore Rd., Bellingham, Wash. 98225

[21] Appl. No.: 26,346

[22] Filed: Mar. 4, 1993

Related U.S. Application Data

[62] Division of Ser. No. 941,499, Sep. 8, 1992.

[51] Int. Cl.[5] ..... C10B 55/00; C10G 7/00

[52] U.S. Cl. ..... 202/121; 196/135; 196/137; 196/155; 202/262

[58] Field of Search ..... 201/23.8; 202/121, 262; 196/135, 137, 155

[56] References Cited

U.S. PATENT DOCUMENTS 2,412,879 12/1946 Fischer ..... 201/23

5,215,651 6/1993 Yamamoto et al. ..... 201/23

*Primary Examiner*—Joye L. Woodard

*Attorney, Agent, or Firm*—Tom F. Pruitt

[57] ABSTRACT

A process for disposing of filter media is provided, which process comprises (a) mixing a filter media with a hydrocarbonaeous mixing stream to form a media-hydrocarbon mixture and (b) feeding said media-hydrocarbon mixture to a coking vessel. Preferred coking vessels include delayed cokers, fluidized cokers, and coke calciners. An apparatus for disposing of filter media is provided, which apparatus comprises (a) a coking vessel; (b) a mixer to mix the filter media with a hydrocarbonaeous mixing fluid to form a media-hydrocarbonaeous fluid mixture; and, (c) a feed means to feed the media-hydrocarbonaeous fluid mixture to the coking vessel. Preferably, the apparatus comprises a size reduction means to reduce the size of the filter media to form a media staple comprising fiber clusters having a desired shape and size.

1 Claim, 1 Drawing Sheet

APPARATUS FOR DISPOSAL OF FILTER MEDIA

This is a division of application Ser. No. 07/941,499, filed Sep. 8, 1992.

BACKGROUND OF THE INVENTION

1. Field of the Invention

In one aspect, this invention relates to a method for disposing of filter media which is contaminated with a hydrocarbonaeous residue. In another aspect, this invention relates to a method of disposing of filter media which has deposited thereon an oily remainder of filtrate. In still another aspect, this invention relates to an apparatus for filter media disposal.

2. Description of the Related Art

Filters are used in petroleum refining to remove undesired substances from selected process streams. For example, waxy compounds, principally of a paraffinic structure, can be filtered from fuel blending streams to enable a fuel product to meet pour point specifications. In addition, high molecular weight, heavy polynuclear aromatic compounds can be filtered from cool hydrocracker effluent streams to remove such heavy compounds and to avoid precipitation of such heavy compounds in downstream process coolers, avoiding cooler fouling when the streams are then further cooled and recycled.

Filters used in refineries, therefore, may have a wide variety of hydrocarbonaeous material deposited upon or entrained by the filter media. Disposal of such filters presents problems. Contaminated filters may be classified as hazardous wastes, subject to special handling and storage considerations and limitations upon ground transportation and other shipping.

Prior art practices for filter disposal have included processing to allow reuse. Treatment of the filter media by fluid washes of the media or solvent extractions of the deposits upon the media can remove, in some instances, at least a portion of the hydrocarbonaeous deposits. To allow reuse of spent wash fluids and solvents, contaminated wash fluids and solvents are treated by distillations, extractions or other separation steps to remove the hydrocarbonaeous materials from the wash fluids or solvents. Such separation processes have special environmental considerations associated with treatment of and disposal of the extracted hydrocarbonaeous materials. In addition, for filters used in some refinery applications, fluid washes and solvent extractions are not effective or efficient to treat contaminated filter media.

SUMMARY OF THE INVENTION

I have discovered a novel method for disposal of filter media. I have discovered how to dispose of filter media contaminated with hydrocarbonaeous deposits in an environmentally safe manner. I have also invented an apparatus for filter media disposal.

In one embodiment of this invention, a process for disposing of filter media comprises (a) mixing the filter media with a hydrocarbonaeous mixing fluid to form a media-hydrocarbon mixture and (b) feeding the media-hydrocarbon mixture to a coking vessel. The term "filter media", as used in the Specification and Claims, means a material adapted to pass a liquid or gaseous stream as filtrate flow and remove from such stream materials, such as suspended or entrained matter, which do not pass through the media. Preferred filter media to which the process of this invention is applied comprise a hydrocarbon-based polymer, although this invention is useful also with media comprising a natural cellulose or synthetic cellulose base. Filter media used in refinery applications, and media as to which practice of this invention is useful, preferably comprise a hydrocarbon-based polymer selected from the group consisting of polyesters, nylons, polyethylenes, polypropylenes, polybutylenes and mixtures thereof, which include derivatives thereof such as block copolymers. Filter media used in refinery applications, and media as to which practice of this invention is useful, may also comprise cotton, rayon and other natural cellulosic or synthetic cellulose-based materials, and mixtures thereof, and combinations with other cellulose-based materials or with hydrocarbon-based polymers.

Filter media effectively treated by the embodiments of this invention preferably include those media constructed or fabricated from continuously extracted filaments or strands of staple fibers spun and woven to form threads which are combined to form continuous media filaments. Preferably treated filter media may also include those media constructed or fabricated into fibrous pellets, fibrous mats or fibrous screens. The construction and fabrication of filter media, and the construction and fabrication of filters, are well known in the art. Filters to which this invention is useful may be in the form of cartridges where the media is placed upon a media support to form the filter, which filter is enclosed alone or with other filters within or held by a cartridge container which has an inlet for receiving the stream to be filtered and outlet for the filtered stream. For instance, a filter may be formed when a number of continuous filaments of media are laid down in a desired pattern and spacing, and wound around a perforated, hollow media support to a desired thickness. Media supports can be of any shape but are often cylindrical. Such media supports may be fabricated from a variety of hydrocarbon-based polymers, including those of which the media is comprised, or may be fabricated from metals, paper materials and other support materials, all of which are well-known in the filter art. Flow of the fluid to be filtered may pass from within the media support and outward through the media, or through the media and into and out of the media support. In lieu of use of a filter support and filter cartridges, filter media, especially fibrous pellets, may be placed loosely, and then compressed, within a filter cavity, which holds the filter media and has, at differing locations, a fluid inlet and outlet, and the flow of fluid to be filtered is directed from the inlet through the media and from the outlet.

If the filter media to be disposed was employed in a manner where no media support was utilized as where the filter media was contained within a filter cavity, then the media may be removed from the filter cavity and directly slurried with a hydrocarbonaeous fluid. For example, pelletized media may be slurried with a fluid without size reduction such as grinding, crushing, cutting, chopping, cutting or other size reduction treatment; however, it is preferred that pelletized media and other media employed without media support be subject to size reduction by grinding, crushing, cutting, chopping, or combinations of such, or to other size reduction methods to create a media staple of desired shape and size. It is preferred that the media staple comprise fiber clusters having a length in the range of about 0.05 to about 0.1 inches and a diameter, or width and height, in the range of about 0.05 to about 0.1 inches, although longer lengths up to and over three inches and diameters, or widths and heights, up to and over 0.3 inches can be used to form a pumpable media-hydrocarbonaeous fluid mixture.

In one variation of one embodiment of this invention, filter media supported upon a media support is removed from the media support and subject to size reduction. Preferably the filter media is cut from the media support by direct cutting, scraping or the like. In another variation, filter media is removed from media support by burning of the filter media with a heating element, such as a heated wire, hot iron, or the like. The media so removed from the support is preferably subject to size reduction by grinding, crushing, cutting, chopping, or combinations of such, or to other size reduction methods to form a media staple of desired shape and size. It is preferred that the media staple comprise fiber clusters having a length in the range of about 0.05 to about 0.1 inches and diameter, or width and height, in the range of about 0.05 inches to about 0.1 inches, although larger lengths up to and over three inches and larger diameters, or widths and heights, up to and over 0.3 inches can be used to form a pumpable media-hydrocarbonaeous fluid mixture.

In the practice of preferred embodiments of this invention, the filter media is mixed to form a slurry with a hydrocarbonaeous mixing fluid which is an existing refinery feed or process stream. Preferably, the mixing fluid is a refinery feed or process stream selected from the group consisting of crude oil, desalted crude oil, reduced crude oil, atmospheric crude tower bottoms, vacuum tower bottoms and residual oils having an initial boiling point per ASTM D86 (American Society of Testing and Materials, distillation procedure D86) of greater than 550° F. Although lower boiling fluids may be employed as mixing fluids, relatively high boiling refinery streams are preferred so that limited or no vapor expansion occurs when the media-hydrocarbonaeous fluid mixture is fed to a coking vessel at elevated temperatures in excess of about 800° F. By admixing the filter media with a liquid hydrocarbonaeous mixing stream, a pumpable media-hydrocarbon slurry is preferably formed. The mixing fluid may also be a hydrocarbon gas such as coker off-gas, and such gas use is within the scope of the claims; however, utilizing a mixing and conveying gas is not preferred.

In the practice of this invention, the hydrocarbon-media mixture is fed to a coking vessel. Suitable coking vessels in use in refineries include delayed cokers, fluidized cokers, and coke calciners and the like. Delayed cokers and fluidized cokers are well-known in the prior art and are known to operate in excess of 800° F. to coke heavy hydrocarbonaeous coker feedstocks and vaporize and recover recoverable light hydrocarbons contained in the coker feedstocks. Coke calciners are also well known in the art and are often operated at elevated temperatures in the range of about 1,900 to about 2,100° F. to further vaporize, coke and calcine a coke feed. The media-hydrocarbonaeous fluid mixture is preferably fed to the coker vessel for the mixture to be treated at high temperatures of coking vessel operations, utilizing coking conditions to vaporize, carbonize, coke, and/or polymerize the filter media and contaminates deposited on the media. The preferred embodiments of this invention permit the use of the coking vessel's existing vapor recovery system to recover recoverable hydrocarbons obtained from coking the contaminated media and hydrocarbonaeous fluid mixture and to recover and treat other vapors which may be vaporized from the filter media and contaminates deposited thereon.

In preferred variations of this embodiment of this invention, filter media is subject to size reduction and having a reduced size is mixed with large volumes of hydrocarbonaeous mixing fluid and in such mixing the amount of media admixed in is very small to provide a low concentration of media, and such concentration of media is preferably on the order of about 0.01 to about 0.05 parts by weight media to 100 parts by weight total media-hydrocarbonaeous fluid mixture. Thus in this variation, the media-hydrocarbonaeous fluid can be fed to the coking vessel with no adverse affect on coke quality, especially for fuel grade coke.

In another embodiment of this invention, the filter media and the media support are both subject to size reduction, either simultaneously or separately, and combined to form a mixture of media and media support which is mixed with a hydrocarbonaeous fluid and fed to a coking vessel. In preferred variations of this embodiment, the media support and the media are comprised of hydrocarbon-based polymers.

DESCRIPTION OF PREFERRED EMBODIMENTS

Figure 1:
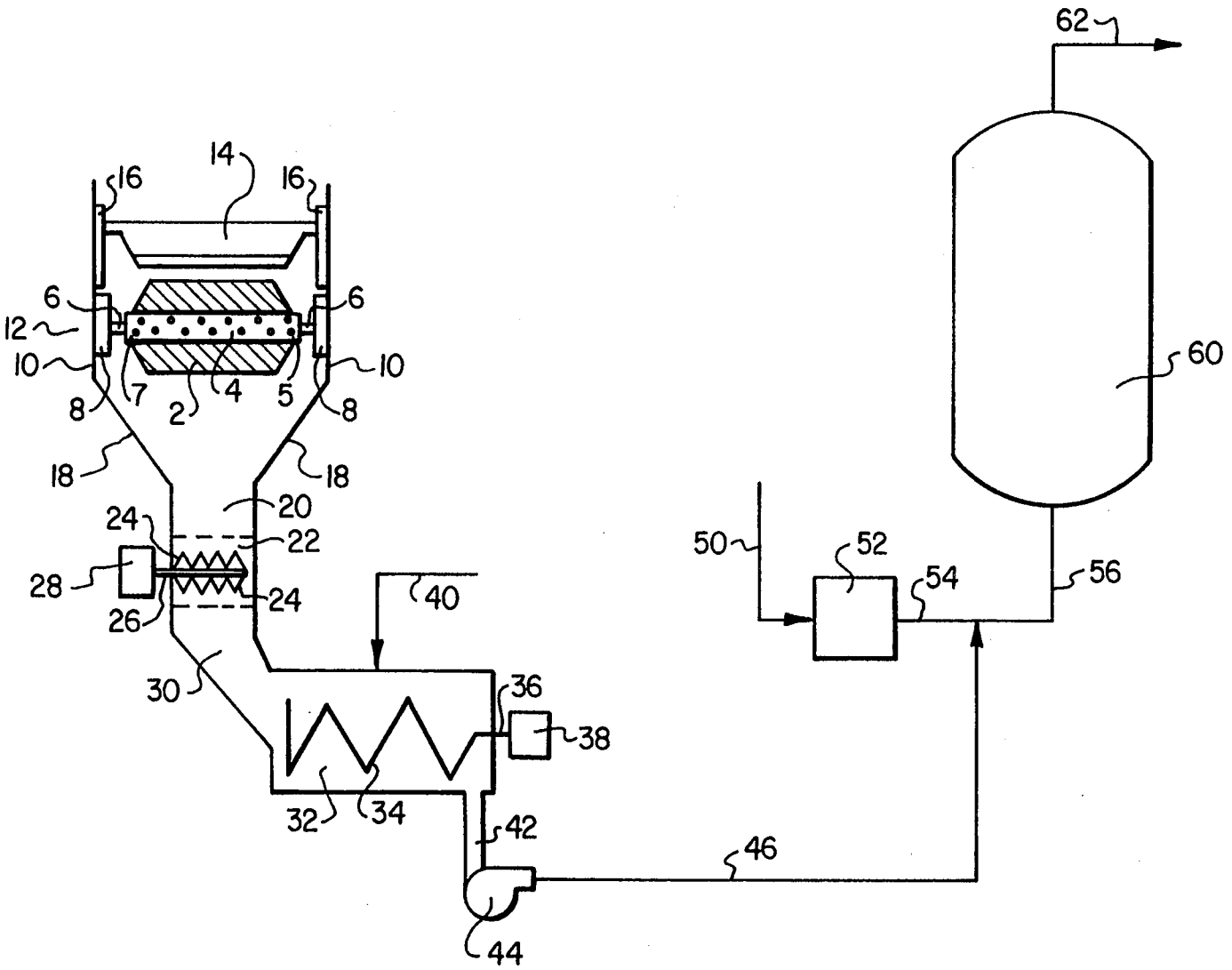
FIG. 1 is a schematic representation of one variation of one embodiment of a method and apparatus of this invention for disposing of filter media.

This invention is further illustrated with reference to FIG. 1 wherein, for purpose of illustration of preferred embodiments, it being understood that this invention is not limited thereto.

In FIG. 1, filter media 2 (cross-section shown), which is to be disposed, is wrapped around perforated media support 4, having two ends 5 and 7. Media 2 may have deposited thereon a hydrocarbon residue (not shown). Media support 4 is supported on ends 5 and 7 by supports 6 which are connected to support base 8 of walls 10 of media cutter 12. Media cutter 12 has a retractable knife 14, supported and retractably guided by guides 16, which knife 14 is adapted to cut or scrape the media 2 from the support 4 so that the media 2 so cut falls to the bottom section 18 of the cutting device 12 and is directed via conduit 20 to a chopper 22. Chopper 22 comprises a motor 28 driven shaft 26 and blades 24 and reduces the cut media (not shown) to a desired size to form size reduced media in conduit 30, which is passed to a slurry means 32 comprising a mixing auger 34, drive motor 38 and drive shaft 36, for mixing hydrocarbonaeous mixing fluid 40 with cut media to form a media-hydrocarbonaeous fluid slurry in conduit 42. Feed means shown as pump 44 passes the slurry 42 via conduit 46 to delayed coker 60 feed line 56. In the coke feed line 56, the slurry 42 in conduit 46 is combined with heated coker feedstock 54 formed from heating by furnace 52 of residual oil feed 50 to the coker 60. In this FIG. 1, the coking vessel 60 is a delayed coking unit having a feed furnace 52 for preheating feed 50 to produce a hot coker feed stream 54, which is combined with the media-hydrocarbonaeous fluid slurry 54 in feed line 56 to the coking vessel 60. Preferably, the coker feed 54 is heated by the furnace 52 to a temperature in excess of about 800° F., and more preferably to a temperature in excess of about 925° F. At the preferred coking temperatures, the media 2 and the mixing fluid 40 of the media-hydrocarbon slurry 42 undergoes thermal cracking and vaporization, coking, carbonization, and/or polymerization in the coking vessel 60. Light hydrocarbons which may have been deposited on the filter media 2 or contained in the hydrocarbonaeous mixing fluid 40 or in the coking feedstock 50 are vaporized and taken overhead for recovery through vapor pipe 62.

While the invention has been described in conjunction with presently preferred embodiments, it is obviously not limited thereto. For example, and not for purposes of limitation, the slurry 42 can be directed via pump 44 and conduit 46 to the inlet of the coker 60 feed furnance 52.

What is claimed is:

1. An apparatus for disposing of filter media in the presence of a hydrocarboneous mixing fluid, wherein said filter media is supported upon a media support and comprises a hydrocarboneous contaminant which is deposited upon or entrained by said filter media, said apparatus comprising:

a. a coking vessel operated at coking conditions;

b. a filter media removal device for removing said filter media comprising said hydrocarboneous contaminant from said media support;

c. a size reducer which subjects said filter media removed from said media support to size reduction to form a media staple comprising said hydrocarboneous contaminant;

d. a mixer to mix said media staple with said hydrocarboneous mixing fluid to form a media-hydrocarboneous mixing fluid mixture; and, e. a feed mean to feed said media-hydrocarboneous fluid mixture to said coking vessel.

* * * * *